US010798481B2

(12) United States Patent
Niu et al.

(10) Patent No.: US 10,798,481 B2
(45) Date of Patent: Oct. 6, 2020

(54) SPEAKER BOX

(71) Applicant: AAC Technologies Pte. Ltd., Singapore (SG)

(72) Inventors: Peng Niu, Shenzhen (CN); Zhichen Chen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/236,502

(22) Filed: Dec. 30, 2018

(65) Prior Publication Data

US 2019/0349669 A1 Nov. 14, 2019

(30) Foreign Application Priority Data

May 9, 2018 (CN) ..... 2018 2 0695851 U

(51) Int. Cl.

| | |
|---|---|
| ***H04R 9/06*** | (2006.01) |
| ***H04R 1/28*** | (2006.01) |
| ***H04R 1/02*** | (2006.01) |
| ***H04R 9/00*** | (2006.01) |

(52) U.S. Cl.
CPC ..... *H04R 1/288* (2013.01); *H04R 1/023* (2013.01); *H04R 1/025* (2013.01)

(58) Field of Classification Search
CPC ... H04R 9/06; H04R 1/28; H04R 1/02; H04R 1/025; H04R 9/00
USPC ..... 381/332–334, 345, 386, 396
See application file for complete search history.

(56) References Cited

U.S. PATENT DOCUMENTS 9,883,266 B2 * 1/2018 Dai ..... H04R 9/06
10,432,766 B2 * 10/2019 Yan ..... H04R 1/288

* cited by examiner

*Primary Examiner* — Suhan Ni
(74) *Attorney, Agent, or Firm* — IPro, PLLC; Na Xu

(57) ABSTRACT

The present disclosure a speaker box including: a lower cover; an upper cover enclosing an accommodating space together with the lower cover; a sounding unit accommodated in the accommodating space. The sounding unit and the upper cover together enclose a front chamber, and the sounding unit. The lower cover and the upper cover together enclose a rear chamber. The speaker box further includes an air-permeable spacer assembly sleeved on an end of the sounding unit located in the rear chamber. The air-permeable spacer assembly includes a frame made of sound-absorbing cotton sleeved on the sounding unit, and an air-permeable spacer connected to a side of the frame close to the lower cover. The rear chamber is filled with sound-absorbing particles, and the air-permeable spacer assembly isolates the sounding unit from the sound-absorbing particles. Compared with the related art, the speaker box disclosure has a better low-frequency acoustic performance.

7 Claims, 4 Drawing Sheets

SPEAKER BOX

CROSS-REFERENCE TO RELATED APPLICATIONS

The present application claims priority to Chinese Patent Application No. 201820695851.6, filed on May 9, 2018, the content of which is incorporated herein by reference in its entirety.

TECHNICAL FIELD

The present disclosure relates to an electroacoustic device, and in particular, to a speaker box.

BACKGROUND

With the advent of the mobile Internet era, the popularity of smart mobile devices is getting higher and higher. Among many mobile devices, mobile phones are undoubtedly the most popular and portable mobile terminal devices. At present, a mobile phone has diverse functions, one of which is high-quality music playing. Therefore, a speaker box for playing sound is widely used in the current smart mobile devices.

The speaker box known in the related art includes a lower cover, an upper cover forming an accommodating space together with the lower cover, a sounding unit accommodated in the accommodating space, an air-permeable spacer assembly, and a mid-wall extending from the upper cover to the lower cover and abutting against the lower cover. The sounding unit and the upper cover together enclose a front chamber. The sounding unit, the lower cover and the upper cover together enclose a rear chamber. The air-permeable spacer assembly is fixed to the mid-wall and they separate the rear chamber into a first rear chamber and a second rear chamber that are in communication with each other. The sounding unit is located in the first rear chamber. The second rear chamber is filled with sound-absorbing particles, and the air-permeable spacer assembly encapsulates the sound-absorbing particles into the second rear chamber to form a virtual sound cavity for improving low-frequency acoustic performance of the speaker box.

However, in the speaker box known in the related art, a large space in the first rear chamber is not utilized to fill with the sound-absorbing particles, failing to maximize the volume of the virtual sound chamber. Therefore, the low-frequency acoustic performance of the speaker box is limited.

Therefore, it is necessary to provide a new speaker box to solve the above technical problems.

BRIEF DESCRIPTION OF DRAWINGS

In order to illustrate technical solutions in the embodiments of the present disclosure, the drawings used in the description of the embodiments will be briefly introduced below. It is obvious that the drawings in the following description merely show some embodiments of the present disclosure, and those skilled in the art can obtain other drawings according to these drawings without any creative efforts.

DESCRIPTION OF EMBODIMENTS

The technical solutions in the embodiments of the present disclosure will be described in detail in conjunction with the accompany drawings of the embodiments of the present disclosure. It is obvious that the described embodiments are only part of the embodiments of the present disclosure, but not all of the embodiments. All other embodiments obtained by those skilled in the art based on the embodiments of the present disclosure without creative efforts fall within the scope of the present disclosure.

Figure 1:
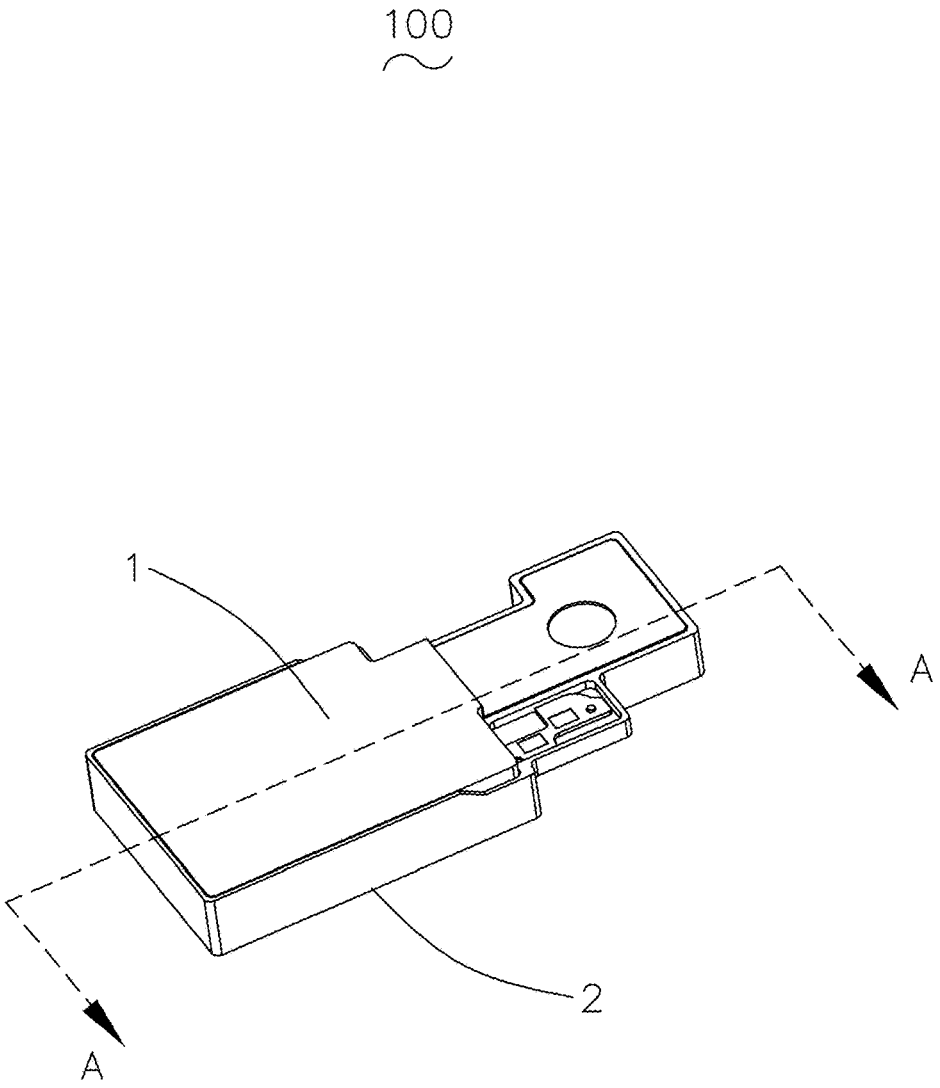
FIG. 1 is a perspective schematic diagram of a speaker box according to an embodiment of the present disclosure.
Figure 2:
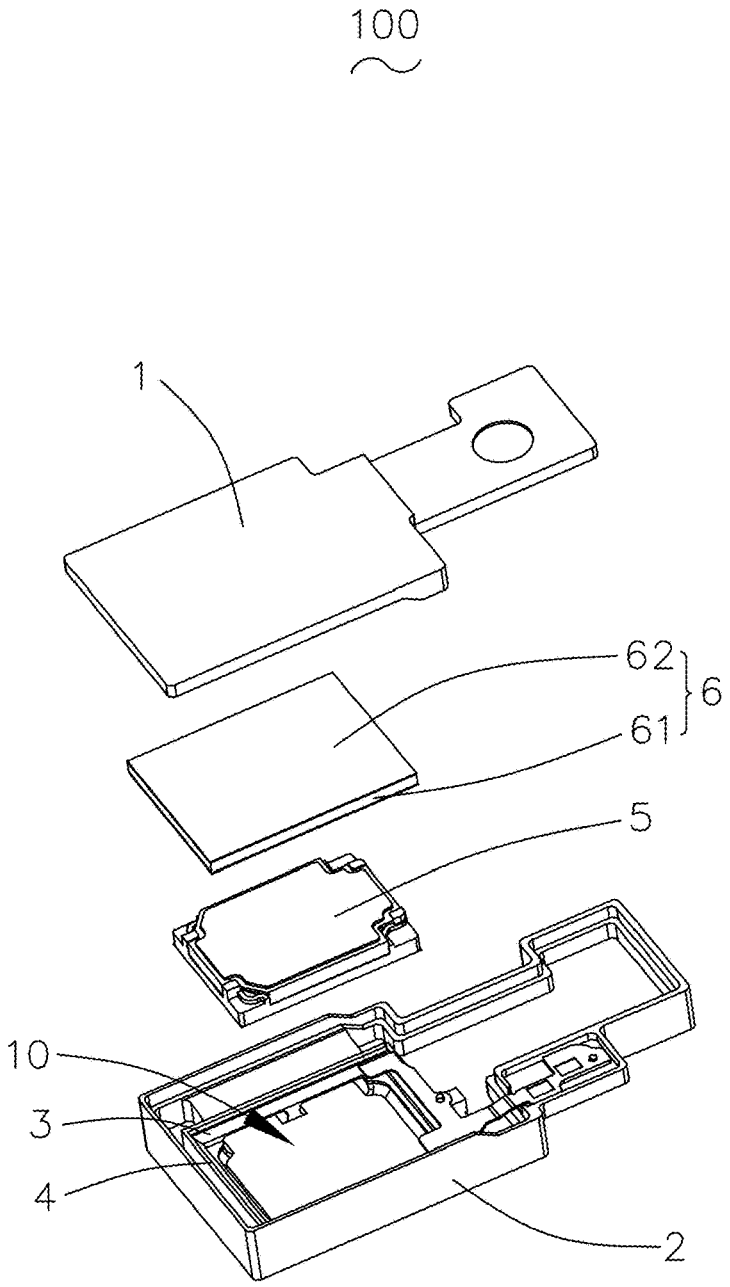
FIG. 2 is an exploded view of a portion of the speaker box shown in FIG. 1.
Figure 3:
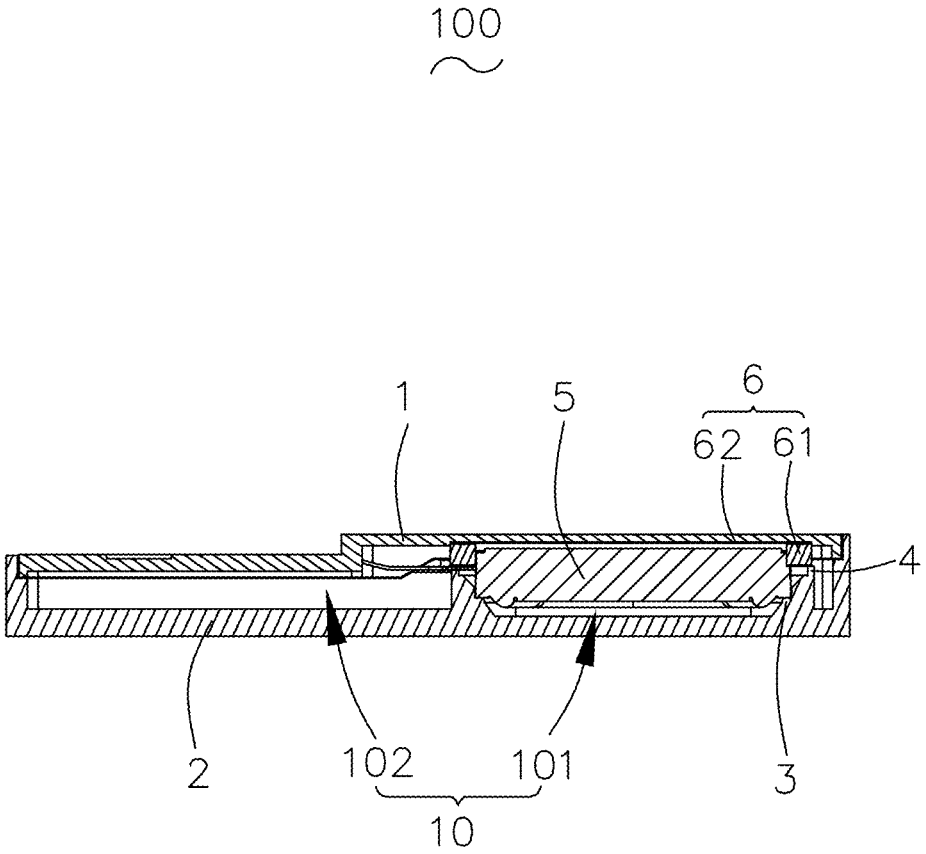
FIG. 3 is a cross-sectional view along line A-A shown FIG. 1.
Figure 4:
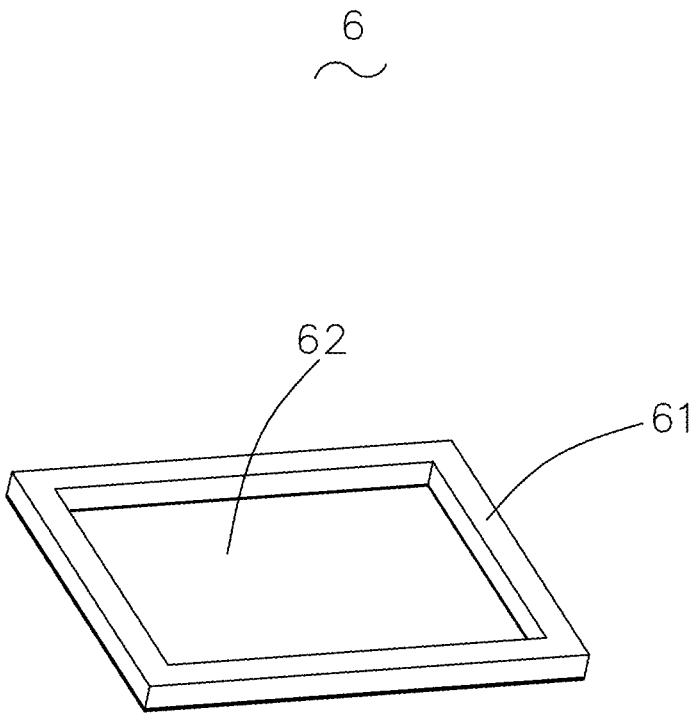
FIG. 4 is a structural schematic diagram of an air-permeable spacer assembly of a speaker box according to an embodiment of the present disclosure.

With reference to FIGS. 1-3, a speaker box 100 provided in an embodiment of the present disclosure includes a lower cover 1, an upper cover 2, a supporting wall 3, a supporting step 4, a sounding unit 5, and an air-permeable spacer assembly 6.

The lower cover 1 and the upper cover 2 constitute an accommodating space 10.

The supporting wall 3 is formed by extending from the upper cover 2 toward the lower cover 1.

The supporting step 4 is formed by extending from a periphery of the supporting wall 3 toward the lower cover 1.

The sounding unit 5 is accommodated in the accommodating space 10. The sounding unit 5 and the upper cover 2 together enclose a front chamber 101 for sounding. The sounding unit 5, the lower cover 1 and the upper cover 2 together enclose a rear chamber 102 for improving the low-frequency acoustic performance.

Specifically, the sounding unit 5 is supported by and fixed to the supporting wall 3 and spaced from the upper cover 2 with the front chamber 101.

The air-permeable spacer assembly 6 is sleeved on an end of the sounding unit 5 located in the rear chamber 102. The rear chamber 102 is filled with sound-absorbing particles, and the air-permeable spacer assembly 6 isolates the sounding unit 5 from the sound-absorbing particles, so as to prevent the sound-absorbing particles from entering the inside of the sounding unit 5. The rear chamber 102 filled with sound-absorbing particles forms a virtual sound chamber for improving the low-frequency acoustic performance of the speaker box 100. In this embodiment, the sound-absorbing particles are zeolite particles.

The air-permeable spacer assembly 6 includes a frame 61 made of sound-absorbing cotton and sleeved on the sounding unit 5, and an air-permeable spacer 62 coupled to one side of the frame 61 close to the lower cover 1.

The air-permeable spacer 62 is used to ventilate and as a barrier. That is, the air-permeable spacer 62 is used to circulate gas and block the sound-absorbing particles. For example, the air-permeable spacer 62 can be a dust screen. In the present embodiment, the air-permeable spacer 62 and the frame 61 can be connected with double-sided tape or glue, but their connection is not limited thereto.

In an embodiment, the air-permeable spacer 62 is spaced from the sounding unit 5 to form an airflow passage for enhancing the air permeability. Moreover, the air-permeable spacer 62 may be spaced from the lower cover 1 to enlarge the filling region.

In the present embodiment, a side of the frame 61 close to the upper cover 2 can be further supported by and fixed to the supporting step 4. The frame 61 and the supporting step 4 can be connected with double-sided glue or glue, which can further improve a barrier effect of blocking the sound-absorbing particles, thereby ensuring an accurate and reliable installation and positioning of the air-permeable spacer assembly 6.

Compared with the related art, in the speaker box according to the present disclosure, since the air-permeable spacer assembly is sleeved on an end of the sounding unit in the rear chamber, the whole rear chamber can be filled and form a virtual sound chamber when the rear chamber is filled with sound-absorbing particles. That is, the volume of the virtual sound chamber of the speaker box is maximized, thereby effectively improving the low-frequency acoustic performance of the speaker box. In addition, the air-permeable spacer assembly has high air permeability, so as to reduce the leakage effect on the sounding unit.

The embodiments described above are merely illustrative. It should be understood that those skilled in the art can make improvements without departing from the concept of the present disclosure, but all of them fall into the protection scope of the present disclosure.

What is claimed is:

1. A speaker box, comprising:

a lower cover;

an upper cover enclosing an accommodating space together with the lower cover;

a sounding unit accommodated in the accommodating space, wherein the sounding unit and the upper cover together enclose a front chamber, and the sounding unit, the lower cover and the upper cover together enclose a rear chamber; and an air-permeable spacer assembly sleeved on an end of the sounding unit located in the rear chamber, wherein the air-permeable spacer assembly comprises a frame made of sound-absorbing cotton and sleeved on the sounding unit, and an air-permeable spacer connected to a side of the frame close to the lower cover, wherein the rear chamber is filled with sound-absorbing particles, and the air-permeable spacer assembly isolates the sounding unit from the sound-absorbing particles.

2. The speaker box as described in claim 1, wherein the air-permeable spacer is a dust screen.

3. The speaker box as described in claim 1, wherein the air-permeable spacer is glued and fixed to the frame.

4. The speaker box as described in claim 1, wherein the air-permeable spacer is spaced from the sounding unit with a spacing.

5. The speaker box as described in claim 1, wherein the air-permeable spacer is spaced from the lower cover with a spacing.

6. The speaker box as described in claim 1, further comprising a supporting wall extending from the upper cover towards the lower cover and a supporting step extending from a periphery of the supporting wall towards the lower cover, wherein the sounding unit is supported by and fixed to the supporting wall, and a side of the frame close to a the upper cover is supported by and fixed to the supporting step.

7. The speaker box as described in claim 6, wherein the frame is glued and fixed to the supporting step.

* * * * *